US007874074B1

(12) United States Patent
Rodriguez-Vega

(10) Patent No.: US 7,874,074 B1
(45) Date of Patent: Jan. 25, 2011

(54) AUTOMOBILE WINDSHIELD REMOVAL TOOL

(76) Inventor: Jesus M. Rodriguez-Vega, 701 NW. 182nd Way, Pembroke Pines, FL (US) 33829

( * ) Notice: Subject to any disclaimer, the term of this patent is extended or adjusted under 35 U.S.C. 154(b) by 512 days.

(21) Appl. No.: 11/784,229

(22) Filed: Apr. 6, 2007

Related U.S. Application Data

(60) Provisional application No. 60/790,287, filed on Apr. 6, 2006.

(51) Int. Cl.
*B26B 1/00* (2006.01)

(52) U.S. Cl. ..... 30/123; 30/140; 30/298

(58) Field of Classification Search ..... 30/298, 30/164.9, 286, 289, 294, 140, 167, 169, 2, 30/342, 338, 336, 320, 393, 383, 505; 219/233, 219/221, 227, 229, 238
See application file for complete search history.

(56) References Cited

U.S. PATENT DOCUMENTS

| | | | | |
|---|---|---|---|---|
| 3,448,517 | A | 6/1969 | Cothery | |
| 3,673,383 | A | 6/1972 | Sofia | |
| 3,845,554 | A * | 11/1974 | Joanis et al. | 30/125 |
| 3,924,327 | A | 12/1975 | Edwards | |
| 3,992,605 | A | 11/1976 | Kraus et al. | |
| 4,539,467 | A | 9/1985 | Wenger | |
| 4,986,875 | A * | 1/1991 | Hamlin, Jr. | 156/584 |
| 5,400,510 | A * | 3/1995 | Glodowski | 30/164.9 |
| 5,784,788 | A * | 7/1998 | Cothery | 30/294 |
| 5,973,294 | A * | 10/1999 | Schatt et al. | 219/228 |
| 6,099,300 | A * | 8/2000 | Rice | 431/255 |
| 6,119,681 | A * | 9/2000 | Lilke | 126/401 |
| 6,434,835 | B1 | 8/2002 | Grunikiewicz et al. | |
| 6,442,844 | B1 | 9/2002 | Grunikiewicz et al. | |
| 2006/0225289 | A1 * | 10/2006 | Glodowski | 30/294 |

* cited by examiner

*Primary Examiner*—Boyer D Ashley
*Assistant Examiner*—Omar Flores-Sánchez
(74) *Attorney, Agent, or Firm*—Kenneth L. Tolar

(57) ABSTRACT

A tool for assisting a worker in removing a windshield includes a cylindrical housing having an L-shaped blade depending from a lower end thereof. The housing includes a butane-fueled heating assembly that heats the blade to a predetermined temperature so that the blade easily penetrates the adhesive surrounding a vehicle windshield. A handle is tethered to the housing with a cable that allows a worker to easily lift the windshield once the adhesive has been completely separated.

4 Claims, 2 Drawing Sheets

AUTOMOBILE WINDSHIELD REMOVAL TOOL

CROSS REFERENCE TO RELATED APPLICATIONS

This application is entitled to the benefit of provisional application No. 60/790,287 filed on Apr. 6, 2006, the specification of which is incorporated herein by reference.

BACKGROUND OF THE INVENTION

The present invention relates to a tool for assisting a worker in removing a windshield from an automobile.

DESCRIPTION OF THE PRIOR ART

A vehicle windshield is peripherally sealed within an opening on the vehicle chassis using a urethane rubber adhesive. Severe cracks and other damage to the windshield often require complete replacement requiring the adhesive to be separated from the windshield with a knife or similar tool, which is cumbersome and laborious. Accordingly, there is currently a need for a tool that allows a worker to more quickly and easily remove the vehicle windshield.

A review of the prior art reveals a myriad of tools for removing a windshield. For example, U.S. Pat. Nos. 6,442,844 and 6,434,835 issued to Grunikiewicz discloses a cutting knife for removing a vehicle windshield including a U-shaped blade that is attachable to an oscillating drive.

U.S. Pat. No. 3,992,605 issued to Kraus et al. discloses an electrically heated tool for removing windshields including an elongated housing having a blade mounted on an end thereof that is heated with a heating element and an associated transformer.

U.S. Pat. No. 4,539,467 issued to Wenger discloses an electrically heated cutting tool including a handle having a blade at an end thereof. The blade is heated by an electrical source connected thereto.

U.S. Pat. No. 3,448,517 issued to Cothery discloses a windshield removal tool including a tubular housing with an L-shaped cutting blade at an end thereof. A heating element is received within the housing for heating the blade. A puller arm is pivotally attached to the lower end of the housing for guiding the heated blade around a windshield.

U.S. Pat. No. 3,924,327 issued to Edwards discloses a powered windshield track cutter including an L-shaped blade attached to an elongated frame member. The device is attachable to an air hammer to automatically cut a windshield track.

Though several windshield removal tools exist in the prior art, each of the conventional tools includes a blade that is heated by an electric current. The maximum temperature to which such blades can be heated is limited thereby greatly limiting their effectiveness. The present invention provides a significant advantage over the prior art tools by including a blade that is heated by a butane-fueled piezo ignition and needle assembly. In addition, the tool includes an adjustable, releasable blade for enhanced versatility.

SUMMARY OF THE INVENTION

The present invention relates to a tool for assisting a worker in removing a windshield including a cylindrical housing having an L-shaped blade depending from a lower end thereof. The housing includes a butane-fueled heating assembly that heats the blade to a predetermined temperature so that the blade easily penetrates the adhesive that typically secures a windshield to a vehicle. A handle is tethered to the housing with a cable that allows a worker to easily lift the windshield once the adhesive has been completely separated.

It is therefore an object of the present invention to provide a tool that allows a worker to quickly and easily remove a windshield from a vehicle.

It is another object of the present invention to provide a tool having a heatable cutting blade for easily severing windshield adhesive.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
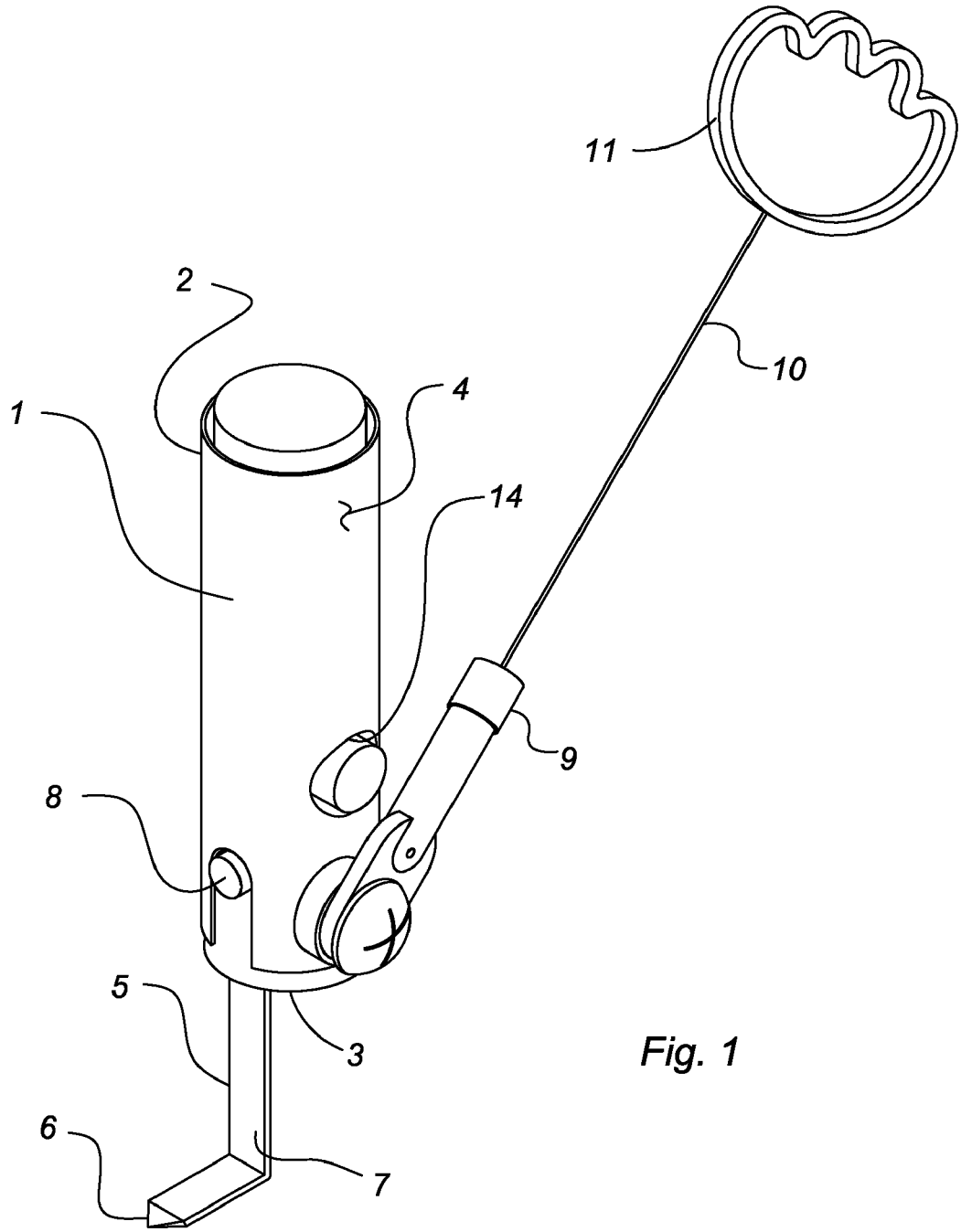
FIG. 1 is a perspective view of the tool according to the present invention.

The present invention relates to a tool for removing a windshield from a vehicle. The device comprises a cylindrical housing 1 having an upper end 2, a lower end 3 and a continuous outer wall 4. Depending from the lower end is a detachable, L-shaped severing blade 5 including a horizontal lower portion 6 and a vertical portion 7 upwardly extending therefrom. A button 8 on the housing outer wall operates an internal locking mechanism to secure and release the blade.

Pivotally mounted on the outer wall of the housing, proximal the lower end, is an arm 9 having a steel cable 10 extending therefrom. At a distal end of the steel cable is a handle 11, which is grasped by a worker when lifting the windshield once its adhesive has been completely separated.

Figure 2:
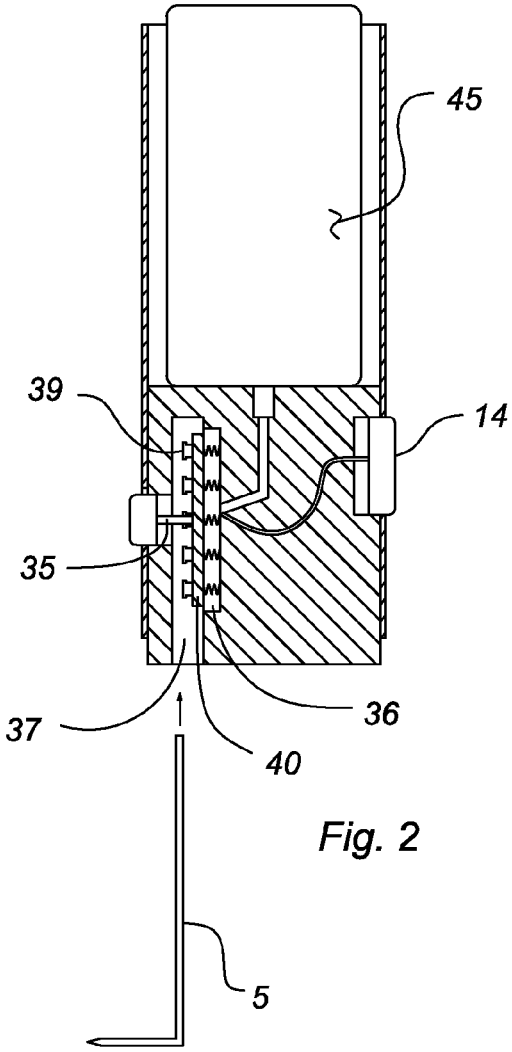
FIG. 2 is a sectional view of the tool.
Figure 4:
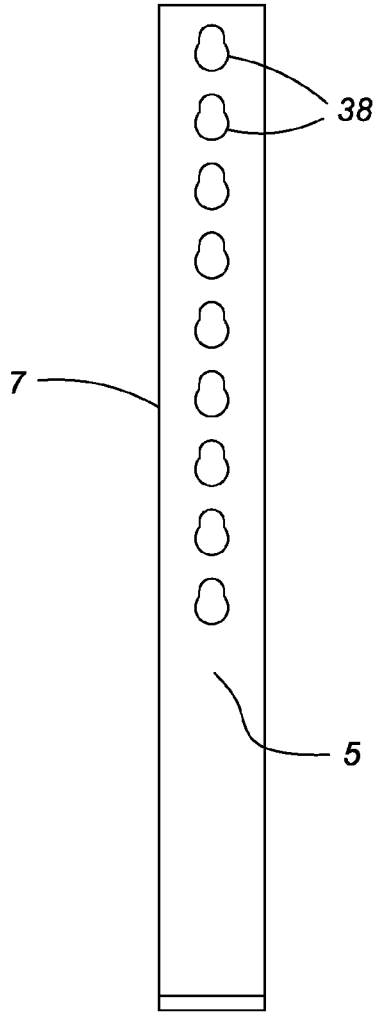
FIG. 4 is a plan view of the blade.
Figure 3:
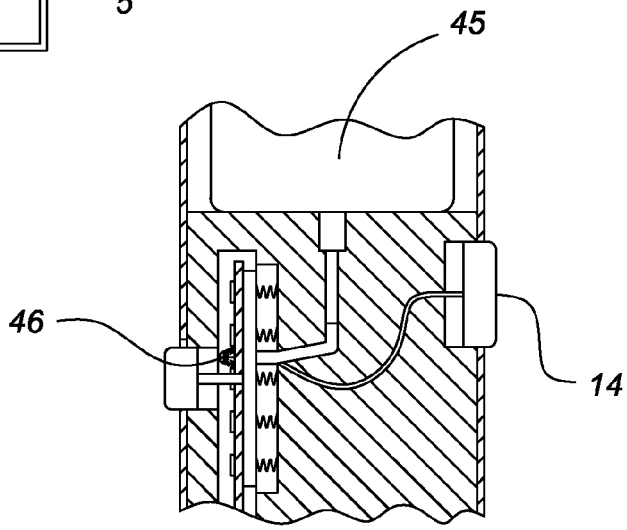
FIG. 3 is a close up view of the blade release means and the burner.

Now referring specifically to FIG. 2, the locking mechanism includes a spring-biased plate 40 having a plurality of locking tabs 39 on a front surface. The plate is normally positioned within a cavity 37 that receives the severing blade. The blade includes a plurality of longitudinally disposed apertures 38 each of which is dimensioned and positioned to receive any one of the locking tabs. A displacement fork extends from the release button 8 which includes a pair of spaced tines 35 for bypassing the blade. One tine is adjacent to a first side edge of the blade vertical portion 7 while the other tine is adjacent to the opposing side edge of the vertical portion 7. A distal end of each tine engages an intermediate portion of the plate. Accordingly, when the button is depressed, the fork pushes the plate into a designated recess 36 to disengage the tabs from the apertures, thereby releasing the blade from the cavity 37.

Also received within the housing is a blade heating mechanism including a butane cartridge 45 that fuels an automated piezo ignition and needle assembly for heating the severing blade. The piezo ignition assembly is conventional and is similar to that found on many multipurpose butane lighters. A starter button 14 activates an igniter that, in combination with the butane, produces a flame within a burner 46 immediately adjacent to the blade. The butane-fueled flame can heat the blade to a temperature of approximately 750 degrees Celsius; preferably, the desired temperature is maintained by a magnetic thermostat.

To use the above described device, the worker activates the butane heating assembly to heat the blade to the predetermined temperature. The horizontal portion of the L-shaped cutting blade is then inserted between the windshield periphery and the vehicle chassis. By manipulating the blade, the worker can easily sever the urethane adhesive that secures the windshield. Once the adhesive is completely separated, the worker grasps the handle and lifts the windshield from its opening. If the blade length needs adjusting, the worker depresses the release button and repositions the blade within the cavity. The worker may also completely remove the blade for storage or if the blade requires replacement.

The above described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. A tool for removing a windshield from a vehicle comprising:

a housing having an upper end, a lower end and an outer wall;

a detachable, L-shaped severing blade depending from the lower end, said blade having a horizontal lower portion and a vertical portion upwardly extending therefrom;

a butane-fueled heating means for heating said severing blade;

a cavity formed at a lower end of said housing having said blade received therein;

a spring-biased plate positioned within said cavity, said plate having a plurality of locking tabs extending therefrom;

a plurality of longitudinally disposed apertures on said severing blade, each of said apertures dimensioned and positioned to receive any one of said locking tabs;

a release button on said housing;

a displacement fork attached to said release button and engaging said plate, said fork having a first tine adjacent to a first side edge of the vertical portion of said blade, and a second tine adjacent to an opposing side edge of the vertical portion, each of said first tine and said second tine having a distal end that engages an intermediate portion of the plate whereby depressing said button causes the fork to push the plate away from said blade to disengage the tabs from the apertures, thereby releasing the blade.

2. The tool according to claim 1 wherein said butane-fueled heating means comprises:

a butane source received within said housing;

an automated piezo ignition assembly in communication with said butane source for heating said severing blade.

3. The tool according to claim 1 further comprising an arm pivotally attached to the lower end of said housing, said arm having a cable extending therefrom, said cable having a handle at a distal end which is grasped by a worker when manipulating said housing.

4. The tool according to claim 1 further comprising a recess formed within said housing and positioned adjacent to said plate whereby when said button is depressed, said fork pushes said plate into said recess to disengage the tabs from the apertures, thereby releasing the blade from said cavity.

* * * * *